United States Patent [19]

Pfeifer

[11] Patent Number: 4,960,213

[45] Date of Patent: Oct. 2, 1990

[54] HANGER SUPPORT GUARD

[75] Inventor: William Pfeifer, Springdale, Pa.

[73] Assignee: Armstrong Store Fixture Coporation, Pittsburgh, Pa.

[21] Appl. No.: 338,161

[22] Filed: Apr. 14, 1989

[51] Int. Cl.[5] ..... A47F 5/00

[52] U.S. Cl. ..... 211/123; 211/105.1; 411/508

[58] Field of Search ..... 211/123, 105.1, 124; 248/205.3, 546, 546; 411/508, 509, 510, 907, 908, 182

[56] References Cited

U.S. PATENT DOCUMENTS

| | | | |
|---|---|---|---|
| 1,576,077 | 3/1926 | Watson | 211/123 |
| 1,936,113 | 11/1933 | Jelliffee | 411/182 X |
| 3,193,231 | 7/1965 | Curry | 248/205.3 X |
| 3,300,173 | 1/1967 | Kennedy, Jr. | 248/546 X |
| 3,704,486 | 12/1972 | Blacklock | 411/508 |
| 4,351,441 | 9/1982 | Schram | 211/207 |
| 4,361,241 | 11/1982 | Stoddard | 211/123 |
| 4,403,703 | 9/1983 | Nikles, Jr. | 211/193 |
| 4,474,299 | 10/1984 | Andrews | 211/193 |
| 4,548,328 | 10/1985 | Brauhing | 211/205 |
| 4,760,929 | 8/1988 | Fedorchak | 211/123 |

FOREIGN PATENT DOCUMENTS

| | | | |
|---|---|---|---|
| 822313 | 8/1937 | France | 211/123 |
| 921029 | 3/1963 | United Kingdom | 411/508 |

*Primary Examiner*—Alvin C. Chin-Shue
*Assistant Examiner*—Daniel Hulsegerg
*Attorney, Agent, or Firm*—Parmelee, Miller, Welsh & Kratz

[57] ABSTRACT

A guard protects the upper surface of a hanger support from scatching by hangers displaying clothing or other merchandise. The support guard has a bottom surface adapted to rest upon the upper surface of a hanger support and has one or more upwardly extending pegs. Downwardly extending posts or caps are attached to the support guard for friction fitting engagement with the hanger support below the bottom surface of the strip.

11 Claims, 4 Drawing Sheets

HANGER SUPPORT GUARD

This invention relates to surface protecting guards and, more particularly, to guards for protecting the exposed surfaces of hanger supports from being scratched by the hangers.

This invention is especially useful for protecting hanger supports attached to the type of merchandise display fixtures frequently found in retail stores for removeably displaying such articles as clothing, packaged goods and the like. It is commercially desireable that the merchandise be attractively displayed in order to best present the merchandise. However, the surfaces of the hanger supports may become badly scratched or otherwise damaged by the hangers when the hangers are carelessly removed from, replaced on or merely pushed along a hanger support. Thus a wide variety of support guards have been developed to protect the surfaces of the hanger supports from the hangers. See, e.g., U.S. Pat. No. 4,760,929 to Fedorchak; U.S. Pat. No. 4,548,328 to Brauning and U.S. Pat. No. 4,361,241 to Stoddard. Although prior art guards are generally satisfactory for protecting hanger supports, there is a constant need for effective guards which are less costly, easier to install and remove, and durable.

SUMMARY OF THE INVENTION

The present invention relates to an improved support guard which is inexpensive to manufacture, is easily installed on a hanger support and later removed without scratching the surface of the support and is durable. When in normal use, the improved support guard will not become loose or lost. The support guard has a strip with a bottom surface adapted to be superposed upon less than about half of the hanger support surface and has a top surface with at least one peg extending upwardly of the strip upper surface. A locking means extends below the bottom surface of the strip in friction-fitting engagement with the hanger support.

In a preferred embodiment of the present invention, the locking means includes at least one post which downwardly extends from a hollow peg. The posts of this structure are particularly resilient and the posts and their pegs may be deformed to urge the posts into possibly misaligned holes in the hanger support. Also, the posts reinforce their pegs against the hangers which occasionally strike the pegs.

In a second preferred embodiment of the present invention, the locking means includes an end cap attached to the strip. The end cap inherently has a relatively large surface in friction fitting engagement with the underlying hanger support for anchoring the guards against impact.

DESCRIPTION OF THE DRAWINGS

Other details, objects and advantages of the invention will become apparent as the following description of certain preferred embodiments thereof shown in the accompanying drawings proceeds.

DETAILED DESCRIPTION

The Figures generally show support guards embodying the present invention for protecting the upper surfaces of cyclindrical tubular supports from scratching by, e.g., hangers. The hanger supports may alternatively be rectangular, ovular or other shape and need not be tubular. The invention embodied in the support guards described below may be readily adapted for use with these and other shapes and therefore the invention need only be described in connection with cylindrical tubular supports.

FIGS. 1-5 generally show a first embodiment of the present invention wherein a support guard 20 protects the peripheral surfaces of a generally horizontally extending hanger support 22 such as a cylindrical tubular arm having a distal end 24 for removeably displaying various types of merchandise (not shown) on hangers 18 to potential customers. The support guard 20 may be a molded plastic such as acrylonitrile-butadienestyrene polymer, a castable metal or other sufficiently tough material which will not easily be scratched or damaged by hangers. Molded plastic is frequently employed in commercial support guards.

Figure 1:
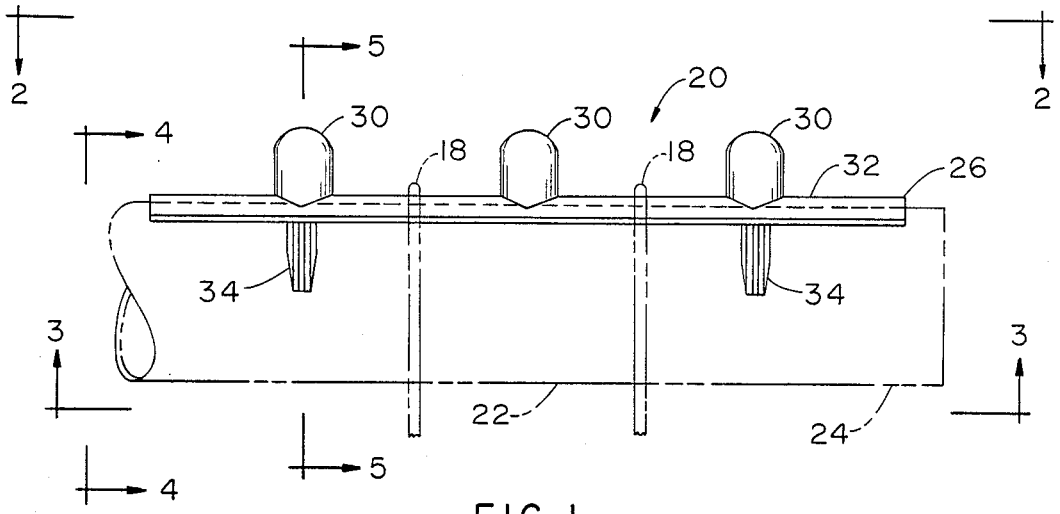
FIG. 1 is a side elevation view of a hanger support guard embodying the present invention superposed on the hanger support shown in phantom with hangers also shown in phantom.
Figure 2:
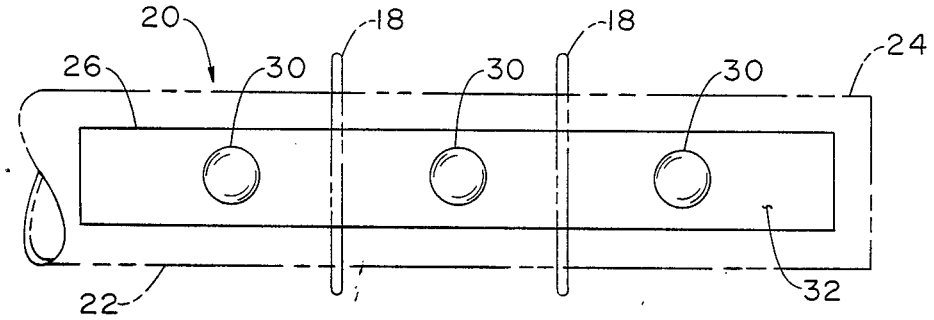
FIG. 2 is a top view of the hanger support guard, hanger support and hangers shown in FIG. 1.
Figure 3:
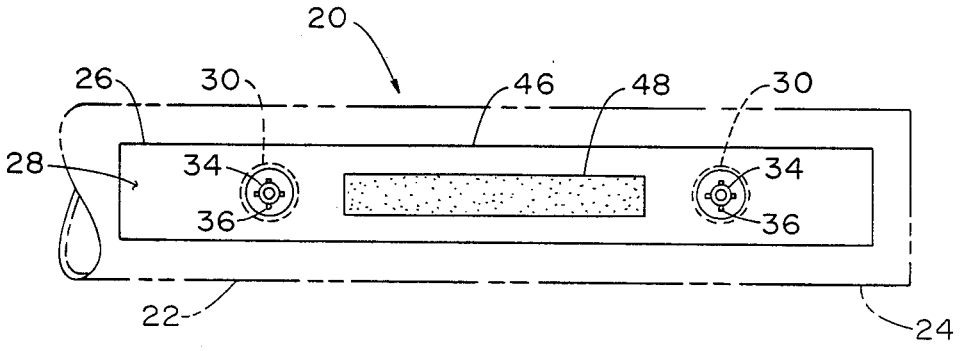
FIG. 3 is a bottom view of the hanger support guard and hanger support of FIG. 1.
Figure 4:
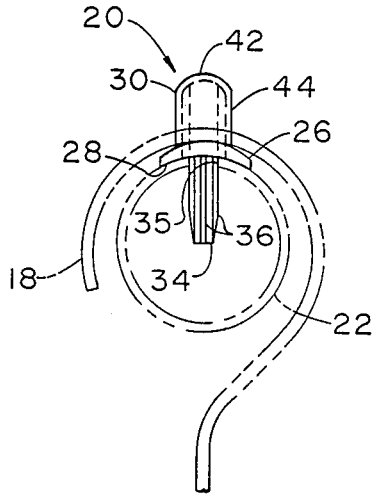
FIG. 4 is an end view of the hanger support guard, hanger support and a hanger of FIG. 1.
Figure 5:
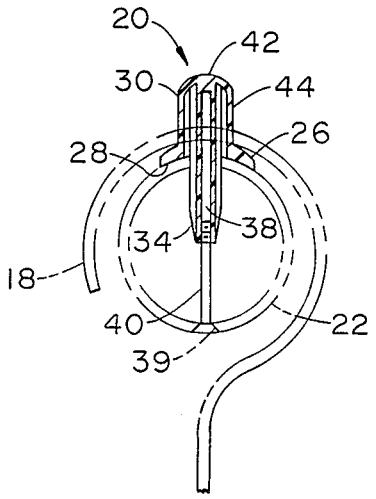
FIG. 5 is a sectional side view of the hanger support guard and hanger support of FIG. 1 taken along section line 5—5 and also showing a fastener attached to a downwardly extending post.

The support guard 20 generally has a strip 26 having a bottom surface 28 adapted to rest on the peripheral surface of the hanger support 22. As is best seen in FIGS. 4 and 5, the strip 26 is superposed on less than about half of the peripheral surface of the hanger support 22. At least one peg 30 extends upwardly from an upper surface 32 of the support guard 20 for restraining lateral movement of the hangers 18. Commercial guards may have up to ten or more pegs extending above a strip. At least one, and preferably at least two, posts 34 or other locking means integrally formed with the strip 26 extend below the bottom surface 28 of the strip 26 in friction fitting engagement with the hanger support 22. The posts 34 extend through holes 35 drilled in the hanger support 22 and may have tapered ribs 36 for facilitating a friction fit in the holes. As is best shown in FIG. 5 the posts 34 may have a center bore 38 for receiving a screw 40 or other fastener extending through holes 39 opposed to holes 35, and extending towards the bottom surface of the hanger support 22 for use where particularly heavy or awkward sized articles are supported.

As shown in FIG. 5, the pegs 30 are preferably in the shape of hollow cups generally defined by a top wall 42 and a side wall 44 and the posts 34 preferably extend downwardly from the underside of the top wall 42 of the pegs 30. This structure is particularly desireable because the holes 35 and 39 in the hanger supports 22 are not always drilled on a perfect pattern and the posts 34 must be sufficiently resilient to accomodate the change. When the support guard is a molded plastic, the posts 34 of FIGS. 1–5 may be rather extensively displaced to fit into a changed pattern as the top surface 42 and the side surface 44 of the pegs 30 may also resiliently deform to accomodate the change. In use, the posts 34 resiliently reinforce the pegs 30 which are occasionally struck by the hangers 18.

Figure 10:
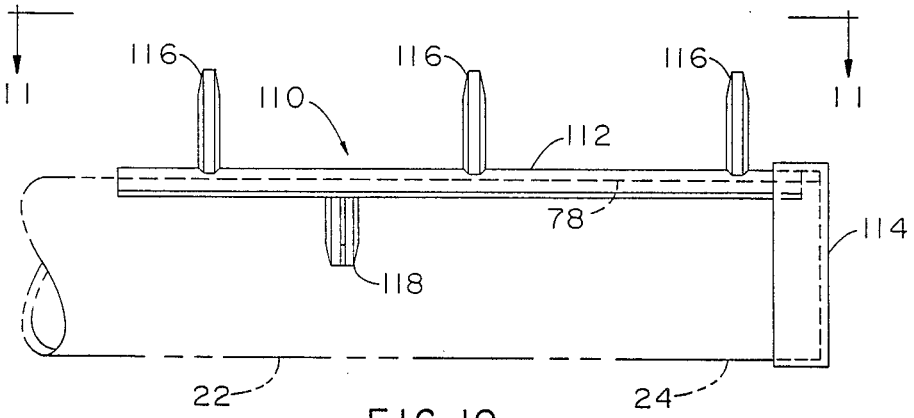
FIG. 10 is a side elevation view of a fourth embodiment of the present invention with a hanger support being shown in phantom.

Alternatively the upwardly extending pegs need not be hollow (see peg 74 of FIG. 8) and need not be cylindrical (see pegs 116 of FIG. 11), and the downwardly extending posts need not extend from the planes defined by the pegs (see post 118 of FIG. 10). In these alternative structures, however, the downwardly extending posts will not be cantilevered over as long a length as are the pegs 34 of FIGS. 1–5 and the upwardly extending pegs will not provide a resilient base for the posts. The support guard 20 of FIGS. 1–5 is preferably molded or cast as one piece. The support guard may also be insert molded and comprise, e.g., at least one downwardly extending metal post and a molded plastic strip. In the structure shown in FIGS. 1–5 where two holes in the hanger support 22 may be relatively close together, the two posts 34 may cause the intermediate portion 46 of the strip 26 to buckle away from the hanger support 22. Thus it may be desireable in this or other cases to adhesively attach to the bottom surface 28 of the strip 26 a tape 48 having both sides adhesively coated for fixing the intermediate portion 46 of the strip 26 of the hanger support 22 and thus urging the posts 36 outwardly against the hanger supports 22. In addition support guards themselves occasionally must be replaced and the support guards 20 may be easily replaced without scratching the exposed surfaces of the hanger support 22 by cutting off the top surface 42 of the pegs 30 and pulling the extending posts from hanger supports 22.

Figure 6:
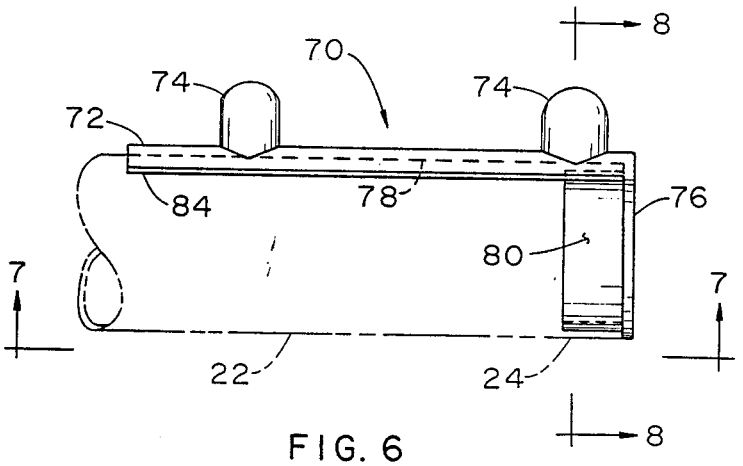
FIG. 6 is a side elevation view of a second embodiment of the present invention wherein the hanger support guard comprises an end cap with a hanger support being shown in phantom.
Figure 7:
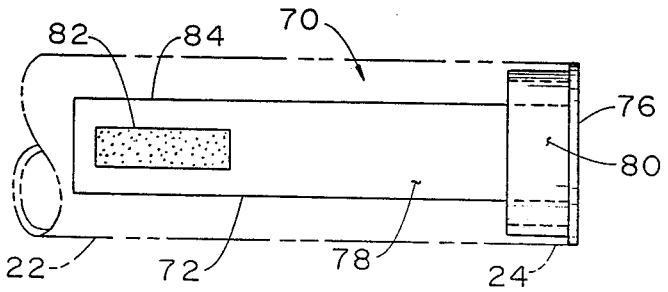
FIG. 7 is a bottom view of the hanger support guard shown in FIG. 6 with a hanger support being shown in phantom.
Figure 8:
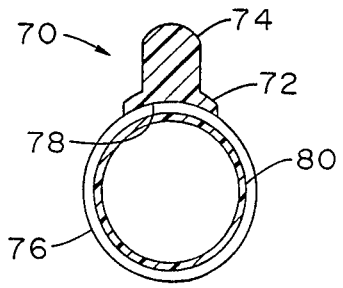
FIG. 8 is a sectional side view of the embodiment of the hanger support guard of FIG. 6 taken along section line 8—8.

FIGS. 6–8 show a support guard 70 embodying the present invention wherein a strip 72 having upwardly directed pegs 74 is integrally formed with an end cap 76 which extends in friction-fitting engagement with the distal end 24 of the hanger support 22. This embodiment of the invention as particularly useful in connection with hanger supports which do not have predrilled holes or holes closely aligned with the posts 34 of the support guard 20 of FIGS. 1–5. The bottom surface 78 of the strip 72 and the sidewall 80 of the end cap 76 define a slot for receiving the hanger support 22 when the cap sidewall 80 is advanced in the distal end 24 of the hanger support 22. The relatively long strip 72 may be easily bent away from the sidewall 80 to facilitate the installation of the cap 76. The strip 72 may alternatively extend from the sidewall of an end cap (not shown) which fits over the distal end 24 of a hanger support 22. An adhesively coated tape 82 may be used as shown in FIG. 7 to attach the inward end 84 of the strip 72 to the hanger support 22. The inherent flexibility of the strip 72 permits the end 84 of the strip to be bent away from the hanger support 22 after the end cap 76 is in place so that a typical protective paper covering on the adhesive coating on the outer side of the tape 82 may be peeled away for fixedly mounting the support guard 70 on the hanger support 22. Alternatively and as is shown in FIGS. 9 and 10, downwardly extending pegs may be employed in place of the tape 82 at the inward end 84 of the strip 72.

Figure 9:
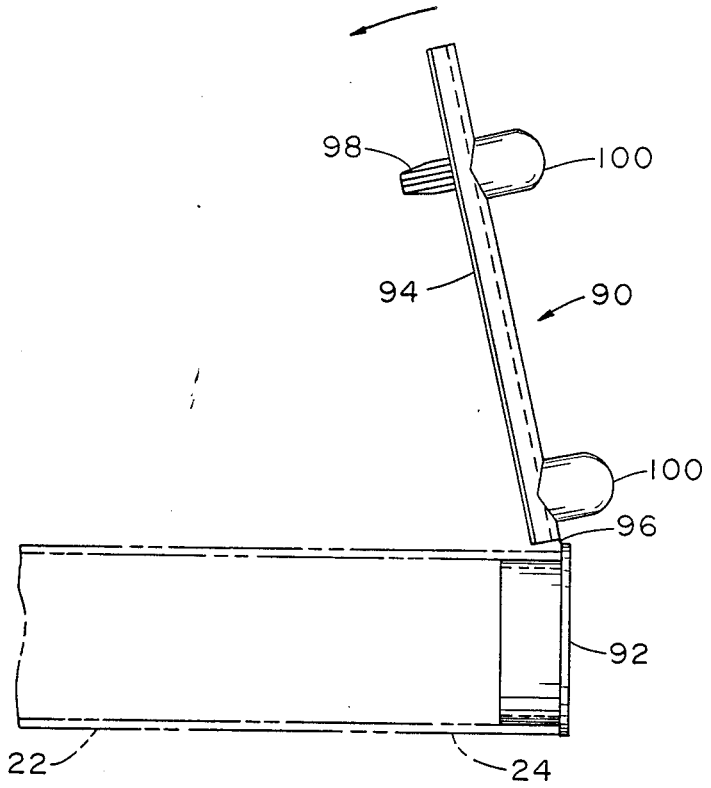
FIG. 9 is side elevation view showing a third embodiment of the present invention wherein the strip is hingedly attached to the end cap.

FIG. 9 shows a support guard 90 embodying the present invention wherein an end cap 92 is integrally hinged to a strip 94. The hinge 96 enables the end cap 92 to rotate between about 90° and 180° of the strip 94. The end cap 92 and the strip 94 may be hinged by a relatively thin flexible section of plastic polymer, or an insert molded fabric or other suitably flexible material, as the support guard will not be applied to more than a few hanger supports in most situations. If the hinge 96 breaks, the support guard 90 may be easily replaced by a new support guard 90. In use, the end cap 92 is inserted into the distal end 24 of the hanger support 22 and the strip 94 is then locked down upon the hanger support 22 by an adhesive tape such as is illustrated in FIG. 7 or by a resilient post 98 extending into the hanger support 22 with pegs 100 extending upwardly. Preferably the hinge is adjacent the top surface of the strip 94 so that the end of the strip 94 can be reinforced by an abutting end cap 92 against axially forces.

Figure 11:
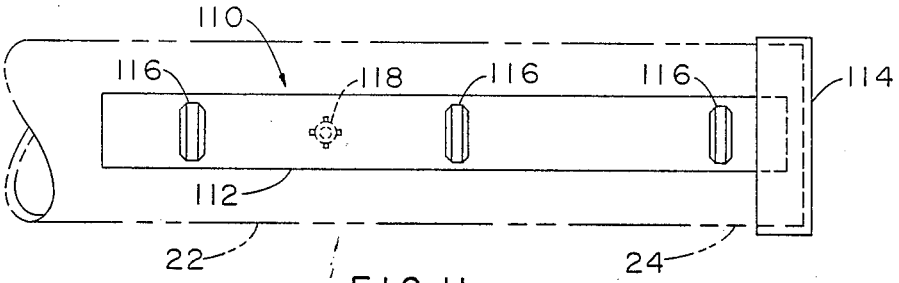
FIG. 11 is a top view of the support guard of FIG. 10.

FIGS. 10 and 11 show a two piece guard 110 generally comprising a strip 112 and a fitting end cap 114. The strip 112 has several extending solid generally rectangular (and attractively c pegs 116 which may be employed in place of the cylindrical shaped hollow pegs 30 shown in FIGS. 1–5 and solid pegs 74 shown in FIGS. 6,8. The strip 112 has at one post 118 extending downwardly for engaging a hole in hanger support 22. The posts 118 may be splined (as are the 34 shown in FIGS. 4 and 5), or alternatively may have tapered outer surface. The posts 118 may extend downwardly from planes defined by the pegs 116 or may extend from the strip 112 intermediately of the pegs 116. Alternately or additionally, an adhesively coated tape may be used to lock the strip 112 to the hanger support 22. In the support guard 110 illustrated, the strip 112 is installed on the hanger support 22 and the friction fitting end cap 114 is then slipped over the distal end 24 of the hanger support 22 and the end of the strip 112. Also, the end cap 114 may be employed in connection with the strip 94 of the support guard 90 shown in FIG. 9 where the hinge 96 may have broken.

While certain presently preferred embodiments of the invention have been shown and described, it is to be distinctly understood that the invention is not limited thereto but may be otherwise variously embodied within the scope of the following claims:

What is claimed is:

1. A support guard for protecting the exposed surface of a hanger support from being scratched by a hanger, comprising:

a strip having a bottom surface and an upper surface, the bottom surface adapted to be superposed upon less than about half of the surface of a hanger support, with at least one hollow peg having sidewalls extending upwardly from the upper surface of the strip to a top wall; and locking means formed with the strip as a single piece and extending from the top wall of the peg to below the bottom surface of the strip, the locking means being separate spaced from the sidewalls of the peg, the locking means adapted for friction-fitting engagement with the hanger support.

2. The support guard of claim 1, wherein the locking means comprises at least one post adapted to be engaged in a hole in the hanger support.

3. The support guard of claim 2, wherein the at least one post extends downwardly from the at least one peg.

4. The support guard of claim 3 wherein the post extends downwardly from the underside of the top wall of the peg.

5. The support guard of claim 4, wherein the support guard has two said pegs having hollow interior portions with said downwardly extending posts, and wherein an adhesive coating is applied to at least a portion of the bottom surface of the strip between the two said pegs.

6. The support guard of claim 1, wherein the locking means comprises an end cap operatively attached to the strip.

7. The support guard of claim 6, wherein the end cap is hingedly attached to the strip.

8. The support guard of claim 7, wherein the hingedly attached end cap is adapted to abut the strip when the support guard is superposed on the hanger support.

9. The support guard of claim 6, wherein the bottom surface of the strip and the end cap define a slot for receiving the hanger support.

10. The support guard of claim 6, wherein at least a portion of the bottom surface of the strip is adhesively coated.

11. A support guard for protecting the surface of a hanger support from being scratched by a hanger comprising a strip having a bottom surface adapted to be superposed upon less than about half the surface of the hanger support, and an upper surface having at least two pegs extending upwardly of the upper surface of the strip, each of the pegs having a hollow interior portion defined by a top wall and a sidewall, and each peg having a post extending downwardly from the top wall of each peg at a distance separated and spaced from the sidewall to below the bottom surface of the strip, each peg adapted to engage in a hole in the hanger support, the strip, the pegs and the posts being formed as a single piece.

* * * * *